US006931809B1

(12) United States Patent
Brown et al.

(10) Patent No.: US 6,931,809 B1
(45) Date of Patent: Aug. 23, 2005

(54) LAMINATED WALL STRUCTURE

(75) Inventors: Jeffrey David Brown, Strafford, PA (US); James Louis McKelvey, Doylestown, PA (US); Michael Joseph O'Brien, Doylestown, PA (US); John Wayne Rimmer, Kintersville, PA (US)

(73) Assignee: Rohm and Haas Company, Philadelphia, PA (US)

( * ) Notice: Subject to any disclaimer, the term of this patent is extended or adjusted under 35 U.S.C. 154(b) by 669 days.

(21) Appl. No.: 09/201,353

(22) Filed: Dec. 1, 1998

Related U.S. Application Data

(60) Provisional application No. 60/068,572, filed on Dec. 23, 1997.

(51) Int. Cl.[7] ..... E04B 2/02; E04B 2/72

(52) U.S. Cl. ..... 52/409; 52/411; 52/446; 52/407.1; 52/309.8; 156/90; 442/20; 428/317.7

(58) Field of Search ..... 52/309.9, 309.5, 52/407.1, 309.8, 408, 409, 411, 446, 454, 449, 741.4, 741.41; 156/90, 306.6; 442/22; 428/317.7

(56) References Cited

U.S. PATENT DOCUMENTS 3,345,246 A * 10/1967 Sheahan ..... 52/309.8 X
3,389,518 A * 6/1968 Horbach ..... 52/309.8
3,466,222 A * 9/1969 Curtis ..... 52/309.8 X
4,783,942 A * 11/1988 Nunley et al. ..... 52/309.1
4,882,888 A 11/1989 Moore
4,961,298 A * 10/1990 Nogradi ..... 52/235
5,027,572 A 7/1991 Purcell et al.
5,067,298 A * 11/1991 Petersen ..... 52/309.8 X
5,224,315 A * 7/1993 Winter, IV ..... 52/309.8
5,753,742 A * 5/1998 Bumanlag ..... 524/501
5,908,877 A * 6/1999 Ci et al. ..... 523/201

* cited by examiner

*Primary Examiner*—Lanna Mai
*Assistant Examiner*—Phi Dieu Tran A
(74) *Attorney, Agent, or Firm*—Ronald D. Bakule

(57) ABSTRACT

A laminated wall structure, suitable for use in an exterior insulation finish system, comprises the following layers in the order provided:

i) a layer of building sheathing;

ii) a layer of water-resistant adhesive which substantially completely covers and adheres to said building sheathing; and iii) a layer of thermal insulation adhered to said building sheathing by said water-resistant adhesive. The laminated wall structure, which can be used with all conventional building sheathings, can require less time to construct than known structures.

14 Claims, 1 Drawing Sheet

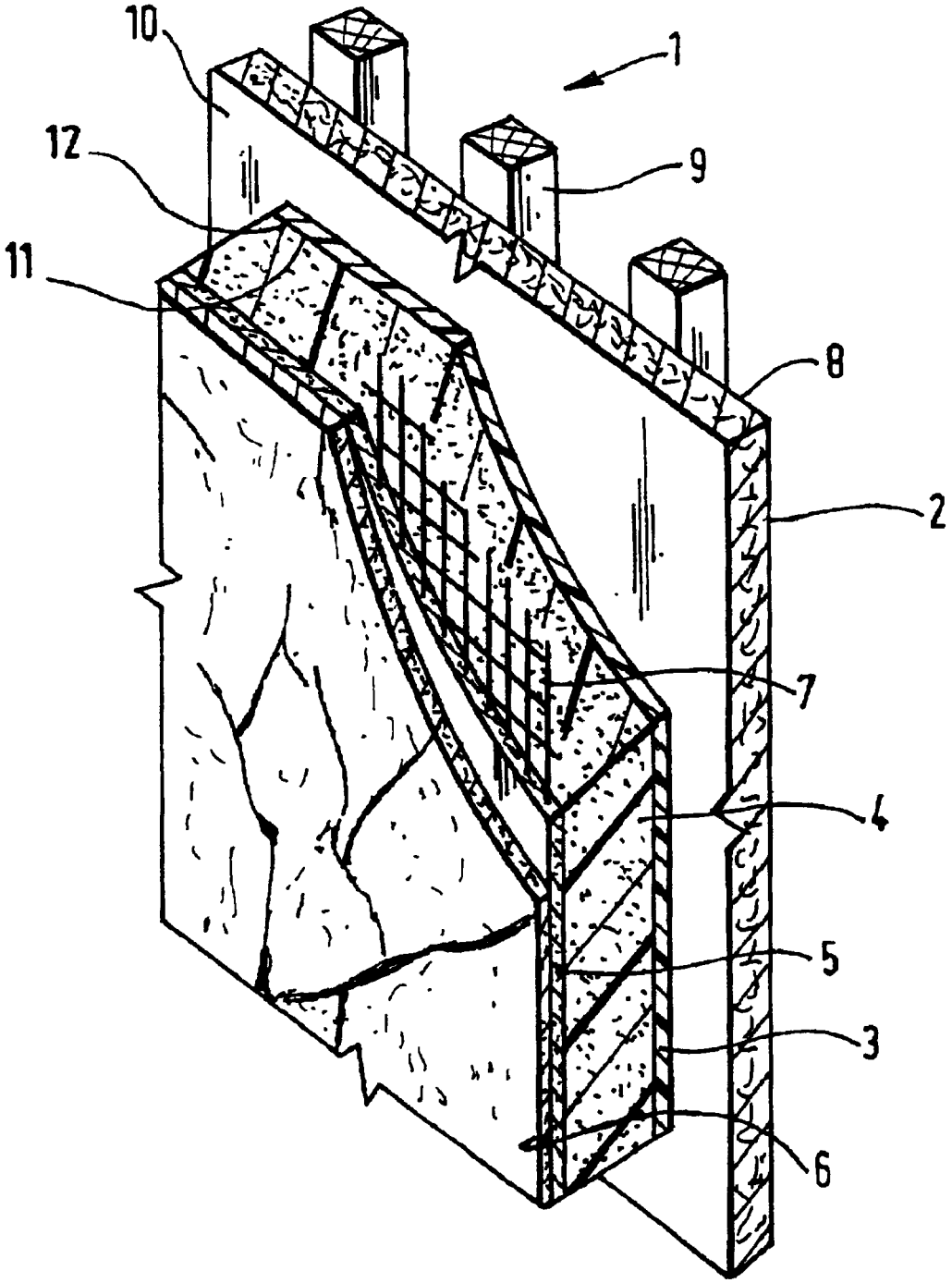
10
1
12
9
11
8
2
7
4
5
3
6

LAMINATED WALL STRUCTURE

This is a nonprovisional application of prior pending provisional application Ser. No. 60/068,572 filed Dec. 23, 1997.

BACKGROUND OF THE INVENTION

This invention concerns laminated wall structures for building exteriors. Particularly, though not exclusively, the present invention relates to laminated wall structures for an exterior insulation finish system.

A building exterior constructed with an exterior insulation and finish system typically includes a laminated wall structure comprising a) a layer of building sheathing, such as wood board, plyboard, chip board, gypsum board, level masonry or concrete; and b) a layer of thermal insulation, such as expanded polystyrene, secured to the exterior surface of the building sheathing. To complete the system, the exterior surface of the thermal insulation is coated first with c) a base coat with a fibreglass reinforcing mesh embedded therein and then with d) a finish coat.

To obviate problems such as delamination and loss of integrity of the laminated wall structure, which can result from either exterior water or condensation penetrating into the building sheathing, especially when a wood- or gypsum-based building sheathing is employed, a water-resistant layer is inserted between the building sheathing and the thermal insulation.

In one embodiment, the water-resistant layer can be a water-resistant membrane, such as asphalt saturated Kraft paper and rag felt, or, as described in U.S. Pat. No. 5,027,572, a polyethylene laminated rubberised asphalt sheet. The water-resistant membrane and thermal insulation layer are secured to the exterior surface of the building sheathing by mechanical fasteners which penetrate through the thermal insulation layer and water-resistant membrane into the building sheathing layer. The process of building this wall can be slow because it requires the use of many mechanical fasteners, each of which must be fitted and secured manually.

In another embodiment, the water-resistant layer can be a water-resistant barrier. For example, as described in U.S. Pat. No. 4,882,888, a laminated wall construction for building exteriors comprises a gypsum-based building sheathing having a non-woven fibreglass layer covering at least one surface thereof, a water-resistant barrier in the form of a coating which completely covers the fiberglass layer, a cementitious adhesive applied on the coated fibreglass sheathing by a conventional ribbon and dab method or notched trowel method for receiving and securing an insulating layer, to the sheathing. The process of building this wall can also be slow because it requires the water-resistant coating to be applied and allowed to dry before the adhesive can be applied and the insulating layer attached. Further, the process relies upon the use of a gypsum board of peculiar construction.

It is the object of this invention to provide a laminated wall structure for an exterior insulation finish system which can require less time to construct than previously described structures and which can be used with all conventional building sheathings.

In accordance with the present invention there is provided a laminated wall structure, suitable for use in an exterior insulation finish system, comprising the following layers in the order provided:

i) a layer of building sheathing;
ii) a layer of water-resistant adhesive which substantially completely covers and adheres to said building sheathing; and
iii) a layer of thermal insulation adhered to said building sheathing by said water-resistant adhesive.

The laminated wall structure of the present invention does not suffer delamination or loss of integrity since the layer of adhesive, which substantially completely covers the surface of the building sheathing to which it adheres, forms a water-resistant layer between the building sheathing and thermal insulation. Further, the laminated wall structure of the present invention does not essentially require the use of mechanical fasteners to secure the thermal insulation to the building sheathing, and so it may be constructed relatively quicker than wall structures which rely upon the use of mechanical fasteners. Furthermore, the laminated wall structure of the present invention, by effectively combining the functions of water-resistant barrier and adhesive, can be constructed relatively quicker than a wall structure which relies upon a process involving the separate steps of applying a water-resistant coating, allowing the coating to dry and finally applying the adhesive to which the thermal insulation is secured. Moreover, the laminated wall structure of the present invention can be employed with all conventional building sheathings and is not reliant upon use of a building sheathing of peculiar construction.

In another aspect, the present invention provides an exterior insulation and finish system comprising the following layers in the order provided:

i) a layer of building sheathing;
ii) a continuous layer of water-resistant adhesive which substantially completely covers and adheres to said building sheathing;
iii) a layer of thermal insulation adhered to said building sheathing by said water-resistant adhesive;
iv) a continuous layer of base coat composition having embedded within it a fibreglass reinforcing mesh; and
v) a continuous layer of finish coat composition.

In yet another aspect, the present invention provides a building exterior, constructed with an exterior insulation and finish system, and including in the following order a layer of building sheathing, a continuous layer of water-resistant adhesive, a layer of thermal insulation, a layer of base coat composition having a fibreglass reinforcing mesh embedded therein, and a layer of finish coat composition.

In yet another aspect of the present invention, there is provided a method of preventing delamination and loss of integrity of a building exterior constructed with an exterior insulation and finish system including a laminated wall structure comprising a) a layer of building sheathing; b) a layer of thermal insulation secured to the exterior surface of the building sheathing; c) a base coat with a fibreglass reinforcing mesh embedded therein adhered to and covering the exterior surface of said thermal insulation layer; and d) a finish coat covering the exterior surface of the case coat, wherein the method comprises coating the exterior surface of said building sheathing with a continuous layer of water-resistant adhesive before securing said insulating layer thereto.

In yet another aspect of the present invention, a water-resistant adhesive is used to provide a continuous water-resistant layer between the external surface of a building sheathing and the internal surface of a thermal insulation of a building exterior constructed with an exterior insulation and finish system including a laminated wall structure comprising a) a layer of building sheathing; b) a layer of thermal insulation adhered to the exterior surface of the building sheathing; c) a base coat with a fibreglass reinforcing mesh embedded therein applied over the external surface of said insulating layer; and d) a finish coat applied over the external surface of said base coat.

The water-resistant adhesive layer is preferably water-resistant for a minimum of 10 minutes, more preferably for a minimum of 30 minutes and most preferably for a minimum of 60 minutes, as measured in accordance with ASTM D-779. The adhesive layer may be so water-resistant that, for all practical purposes, it can be considered a being waterproof.

The water-resistant adhesive layer preferably has a moisture vapour transmission rate of from about 4 grams, more preferably from about 5 grams, up to about 35 grams per square metre per 24 hours, as measured in accordance with ASTM E-96 Proc B.

The water-resistant adhesive layer preferably consists of a water-based, water resistant, non-cementitious adhesive. Preferably the adhesive is acrylic, although other water-based, water-resistant adhesives may be useful, such as vinyl acrylic, ethylene vinyl acetate, styrene acrylic, styrene butadiene rubber, and vinyl chloride acrylic]. Such adhesives are generally available and the skilled person will know, or will readily be able to determine, which of these will be most suited for use in the present invention. For example, water-based, water-resistant, non-cementitious adhesives comprising one or more of the following commercially available polymeric binders are suitable for use in the present invention: Rhoplex 2019R, Rhoplex EI2000, Rhoplex 2200, Rhoplex EC2848 and Rhoplex A-920 available from Rohm and Haas Company; Acronal 567V available from BASF AG; and UCAR 123 available from Union Carbide Corp. Although these commercially available binders are all capable of being formulated into water-resistant adhesives suitable for use in the present invention, it is preferred to use a styrene-free binder, such as Rhoplex EI2000, Rhoplex EC2848 or Rhoplex A-920, as these tend to give higher moisture vapour transmission rates.

Preferably, the water-resistant adhesive layer consists of a water-based adhesive comprising a polymeric binder comprising units of one or more of the following monomers: (C1 to C8)alkyl (meth)acrylates, preferably ethyl acrylate and/or butyl acrylate; styrene; acrylonitrile; acrylamide and (meth) acrylic acid. The polymeric binder preferably has a glass transition temperature (Tg) in the range −50° C. to +30° C., more preferably −35° C. to 10° C., to give the adhesive formulation a good balance of flexibility and crack bridging, to accommodate expansion, contraction and other movements normally found in building structures. The adhesive formulation may comprise other components such as tackifiers or other ingredients to give the adhesive "quick grab" properties, to prevent slippage of the thermal insulating layer and minimize the time required to rasp/sand the thermal insulating layer to receive the base coat layer.

The adhesive may be applied to the building sheathing by any appropriate method. For example, it may be applied by brush, roller, trowel or by spraying.

The invention is now further exemplified with reference to the accompanying drawing, in which:

FIG. 1 is a schematic, fragmentary, perspective view, partially in cross section, of a building exterior, including a laminated wall structure of the present invention showing various layers and their relationship to one another.

A building exterior 1, constructed with an exterior insulation and finish system, includes a laminated wall structure, in accordance with the present invention, comprising a plywood building sheathing 2, a continuous layer of water-resistant adhesive 3 and a layer of expanded polystyrene thermal insulation 4. The building exterior also includes a base coat composition 5, which in turn is coated with a finish coat 6. Embedded within the base coat 5 is a fibreglass reinforcing mesh 7.

The building exterior 1 is constructed as follows:

The inner surface 8 of a 2.5 cm thick plywood board 2 is secured to a building framework 9 by any conventional means. Once secured, a water-resistant adhesive, having the formulation listed in Table 1, is troweled over the exterior surface 10 of the plywood board 2 to form a continuous water-resistant layer 3, approximately 1.5 mm thick, which completely covers and adheres to the exterior surface of the plywood board. The adhesive has sufficient tack such that immediately or shortly after it has been applied to the exterior surface 10 of the plywood board 2 to form the water-resistant adhesive layer 3, the inner surface 11 of a 5 cm thick sheet of polystyrene thermal insulation 4 can be pressed into contact with the exterior surface 12 of the adhesive layer 3, thereby to securely adhere the thermal insulation into position. The adhesive is sufficiently strong such that, in use, no other means of securing the thermal insulation to the plywood board 2 is essentially required.

Once the polystyrene insulation layer 4 has been adhered into position, a conventional base coat material (such as Primus/Adhesive from Dryvit, RFP from Sto, 3.01 Basecoat & adhesive from Parex, A/BC from Finestone or Alpha Base from Senergy) is applied to the outer surface of the insulating layer and a woven fibreglass reinforcing mesh 7 is positioned and embedded therein, thereby adhering the mesh 7 to the insulating layer 4. A conventional finish coat material 6 (such as Quarz Putz from Dryvit, StoLit R 1.5 from Sto, 3.20 and 500 Series Finishes from Parex, Swirl Texture Finish from Finestone or Classic Finish from Senergy) is then applied to the external surface of the base coat 5.

TABLE 1

Water-resistant Adhesive

| Ingredient | | Kg | liters | PVC | Wt % |
|---|---|---|---|---|---|
| 250 um Silica Sand | | 170 | 63.2 | 25.78 | 27.04 |
| 10 um $CaCO_3$ | | 205.5 | 76.2 | 30.9 | 32.78 |
| Colloidal Attapulgite Clay | | 5.85 | 2.5 | 1.01 | 0.93 |
| Rutile $TiO_2$ | | 2.9 | 0.75 | 0.31 | 0.47 |
| Acrylic Binder Rhoplex EC2848 | | 181.5 | 174 | — | 28.95 |
| Fatty acid defoamer | Nopco NXZ | 0.45 | 0.49 | — | 0.07 |
| water | | 4.5 | 4.5 | — | 0.72 |
| Alkylaryl polyether, nonionic surfactant | Triton CF-10 | 0.45 | 0.42 | — | 0.07 |
| Sodium salt of a carboxylated polyelectrolyte, dispersant | Tamol 731 A | 1.84 | 1.66 | — | 0.29 |
| Thickener | WHT-100 | 2.26 | 2.16 | — | 0.36 |
| water | | 50.5 | 50.5 | — | 8.05 |
| 2,2,4-Trimethyl-1,3-pentanediol monoisobutyrate | Texanol | 3.33 | 3.52 | — | 0.53 |
| Fatty acid defoamer | Nopco NXZ | 0.9 | 1 | — | 0.14 |
| | Totals | 627 | 378.5 | | |
| | PVC | 58 | | | |
| | Volume solids | 65 | | | |
| | Wt solids % | 79 | | | |
| | Viscosity Paste Units | 120 | | | |

TABLE 1-continued

| Ingredient | Water-resistant Adhesive | Kg | liters | PVC | Wt % |
|---|---|---|---|---|---|
| | (Brookfield Model KU-1 paste paddle) pH | 9.25 | | | |

We claim:

1. A laminated wall structure, suitable for use in an exterior insulation finish system, comprising the following layers in the order provided:

i) a layer of building sheathing;

ii) a barrier layer of water resistant adhesive which substantially completely covers and adheres to said building sheathing; and iii) a layer of thermal insulation adhered to said building sheathing by said water-resistant adhesive, wherein said barrier layer of water-resistant adhesive further comprises a water-based, water-resistant, non-cementitious adhesive having sufficient tack to rapidly secure said layer of thermal insulation to said building sheathing.

2. A laminated wall structure as claimed in claim 1, wherein said barrier adhesive layer is an acrylic-based material.

3. A laminated wall structure as claimed in claim 1, wherein said barrier adhesive layer comprises a polymeric binder comprising units of one or more of the following monomers: (C1 to C8) alkyl (meth)acrylates; styrene; acrylonitrile; acrylamide and (meth)acrylic acid.

4. A laminated wall structure as claimed in claim 1, wherein said barrier adhesive layer comprises a polymeric binder having a glass transition temperature (Tg) in the range −50° C. to +30° C.

5. A laminated wall structure as claimed in claim 1, wherein the water-resistant barrier adhesive layer is water-resistant for a minimum of 30 minutes, as measured in accordance with ASTM D-779.

6. A laminated wall structure as claimed in claim 1, wherein the water-resistant barrier adhesive layer preferably has a moisture vapor transmission rate of from 4 up to 35 grams per square meter per 24 hours, as measured in accordance with ASTM E-96 Proc B.

7. An exterior insulation and finish system comprising the following layers in the order provided:

i) a layer of building sheathing;

ii) a continuous barrier layer of a water-based, water-resistant, non-cementitious adhesive which substantially completely covers and adheres to said building sheathing, said adhesive having sufficient tack to rapidly secure said layer of thermal insulation to said building sheathing;

iii) a layer of thermal insulation adhered to said building sheathing by said adhesive;

iv) a continuous layer of base coat composition having embedded within it a fibreglass reinforcing mesh; and v) a continuous layer of finish coat composition.

8. A building exterior, constructed with an exterior insulation and finish system, and including in the following order a layer of building sheathing, a continuous barrier layer of a water-based, water-resistant, non-cementitious adhesive, a layer of thermal insulation, a layer of base coat composition having a fibreglass reinforcing mesh embedded therein, and a layer of finish coat composition, said adhesive having sufficient tack to rapidly secure said layer of thermal insulation to said building sheathing.

9. A method for constructing a laminated wall structure, suitable for use in an exterior insulation finish system, comprising:

i) securing a layer of building sheathing;

ii) applying a barrier layer of a water-based, water-resistant, non-cementitious adhesive which substantially completely covers and adheres to said building sheathing, said adhesive having sufficient tack to rapidly secure a layer of thermal insulation to said building sheathing; and iii) disposing said layer of thermal insulation adjacent to said layer of building sheathing.

10. The method as claimed in claim 9, wherein said barrier adhesive layer is an acrylic-based material.

11. The method as claimed in claim 9, wherein said barrier adhesive layer comprises a polymeric binder comprising units of one or more of the following monomers: (C1 to C8) alkyl (meth)acrylates; styrene; acrylonitrile; acrylamide and (meth)acrylic acid.

12. The method as claimed in claim 9, wherein said barrier adhesive layer comprises a polymeric binder having a glass transition temperature (Tg) in the range −50° C. to +30° C.

13. The method as claimed in claim 9, wherein said barrier adhesive layer is water-resistant for a minimum of 30 minutes, as measured in accordance with ASTM D-779.

14. The method as claimed in claim 9, which provides a method for constructing an exterior insulation and finish system further comprising:

iv) applying a continuous layer of base coat composition having embedded within it a fibreglass reinforcing mesh to said thermal insulation layer; and v) applying a continuous layer of a finish to said layer of said base coat composition.

* * * * *